United States Patent [19]

Woodward

[11] Patent Number: 4,544,012

[45] Date of Patent: Oct. 1, 1985

[54] SUNSCREEN THERMAL AND FRAME ASSEMBLY

[76] Inventor: Fred Woodward, 720 E. Dunlap, Phoenix, Ariz. 85020

[21] Appl. No.: 569,787

[22] Filed: Jan. 12, 1984

[51] Int. Cl.[4] ..... E06B 3/32

[52] U.S. Cl. ..... 160/90

[58] Field of Search ..... 160/87, 89, 90, 228, 160/371, 380, 382, 383

[56] References Cited

U.S. PATENT DOCUMENTS

| | | | |
|---|---|---|---|
| 1,660,227 | 2/1928 | Levine et al. | 160/228 |
| 1,775,717 | 9/1930 | Everhard | 160/371 |
| 4,232,310 | 11/1980 | Wilson | 160/371 |

*Primary Examiner*—Peter M. Caun

*Attorney, Agent, or Firm*—Basil E. Demeur; Robert E. Knechtel

[57] ABSTRACT

There is disclosed a sunscreen and thermal insulation assembly which may be constructed on site, formed by a screen frame base having an upper end and lower end terminating in a lower nose end having gripping means associated therewith, the screen frame base also including locking means formed thereon, a screen frame insert having an upper end terminating in a top edge and a lower end terminating in a lower nose end having second gripping means associated therewith, the screen frame insert having mating locking means formed thereon for mating engagement with the first locking means of the screen frame base, and also including mounting means formed thereon, a glass frame section adapted to carry a glass panel having mating engagement means for mounting with the mounting means on the screen frame insert, each of the screen frame base and screen frame insert and glass frame sections being adapted to be cut into correspondingly equal sections thereby to create an assembly which may overlie an existing window to function as a sunscreen as well as thermal barrier.

8 Claims, 10 Drawing Figures

FIG. 4
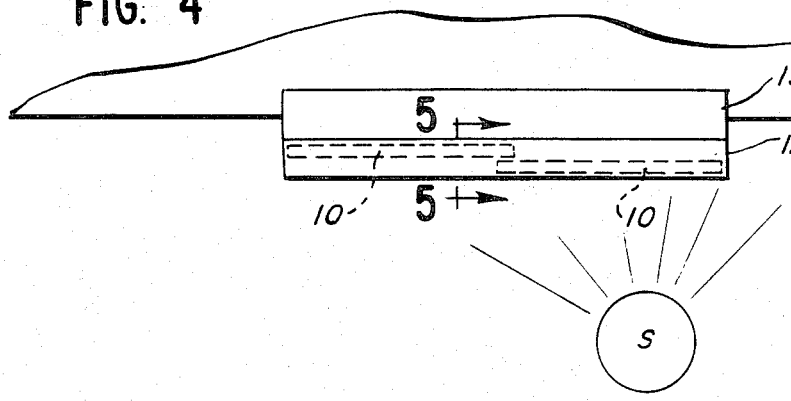
FIG. 5
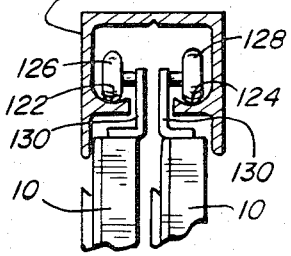
FIG. 6
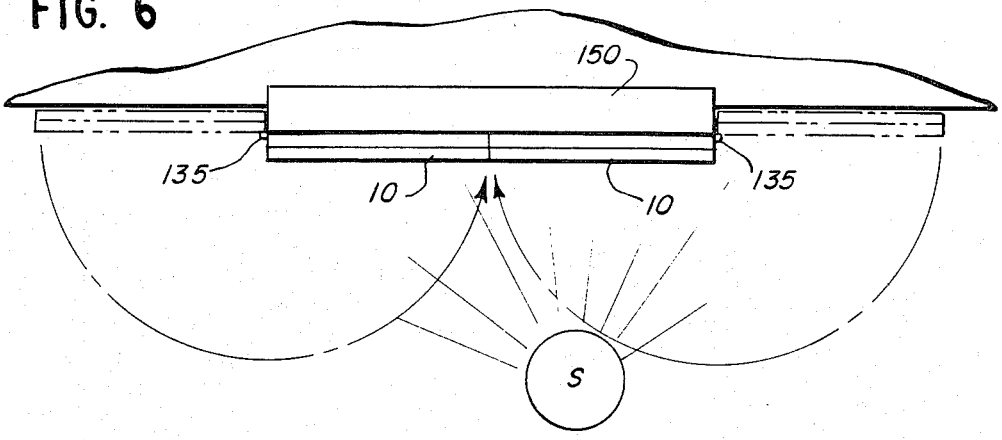
FIG. 7
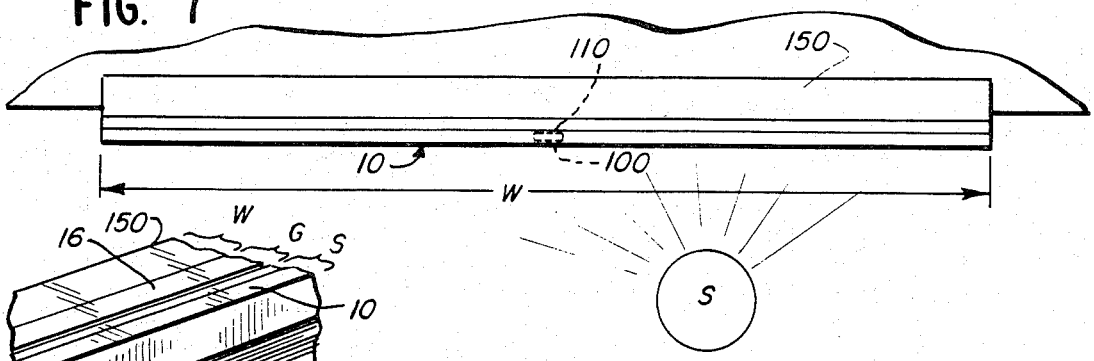
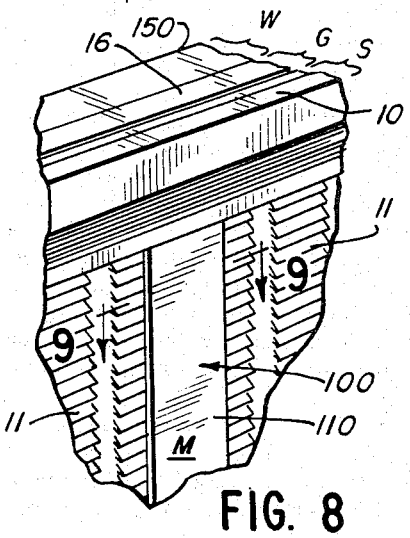
FIG. 8
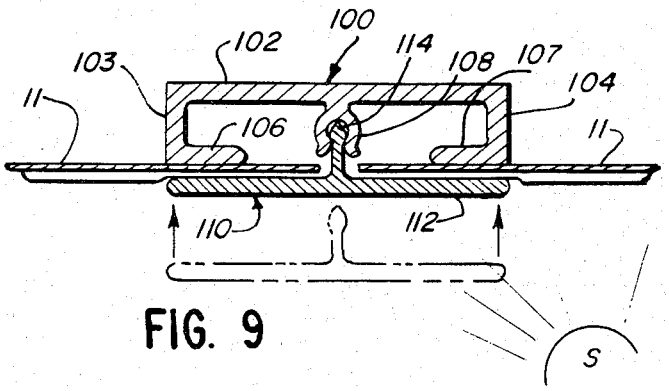
FIG. 9

SUNSCREEN THERMAL AND FRAME ASSEMBLY

BACKGROUND OF THE INVENTION

In many geographic sections of the country, especially those areas where the climate is extremely warm, it has been found to be desirable to construct sunscreens to overlie an existing window with the purpose of reflecting away the rays of the sun. This is especially true in locations where the weather is extremely hot, and direct sunlight poses a difficult problem for maintaining efficient air-conditioning in the interior portions of the structure.

In a typical installation, a sunscreen may be formed of any reflective material, whether metallic or otherwise, and in many cases is simply hung on the inside of the window in order to reflect away the sunlight. In those situations where a permanent installation is desired, the sunscreen must either be built into the entire window frame assembly, such as a roll away type screen, or a separate sub-assembly must be manufactured and installed either internally of the existing window, or externally thereof. That type of installation generally requires a custom made assembly, which is accomplished by the builder measuring the window opening, and then ordering an assembly from a manufacturer constructed to the exact measurements of the window frame. This procedure is usually followed in those instances where the owner of an existing building seeks to install either a sunscreen assembly or a thermal insulated assembly over existing windows. In such instances, it is quite apparent that the owner of the building must have all of the windows measured, and the assembly is then constructed by the manufacturer to the exact dimensions ordered, after which the assemblies are shipped to the site location for installation.

In accordance with the present invention, it is deemed desirable to provide a sunscreen assembly which may also include a thermal insulation barrier, which may be provided in the form of elongated extruded strips which may be cut to any desired length on situs, such that a sunscreen and/or thermal assembly may be constructed to the exact dimensions of an existing window. In addition, it is also deemed desirable to provide such an assembly which may easily be assembled without the need for any extraneous locking means or fastening means, such as screws, nails or the like. Hence, the present invention contemplates an assembly formed by three basic elements, and constructed in such a manner that each of the three elements is formed with integrated locking means formed therein such that the assembly may be snapped together once the pieces are cut to the exact dimensions desired. In this manner, a sunscreen assembly as well as a thermal insulated barrier may be fully constructed on site, and mounted over existing windows without the need of measuring each and every window and ordering on a customer order basis, an assembly which will fit each window.

The prior art with regard to snap lock construction does show a variety of structures which may be snap locked together such as, for example, U.S. Pat. No. 3,310,923. As indicated therein, frame members, partitions and locking members may be formed from a material which can be extruded, rolled or otherwise formed in order to render such members suitable for installation on site. However, the existing prior art with respect to thermal windows clearly indicates that in the usual situation, thermal windows, such as storm window assemblies and the like, are created from aluminum, and in each instance, the existing windows must be measured, the storm assembly units manufactured at a separate site, and then shipped to the building owner for installation over the existing windows. Snap together members which permit the construction and insulation on situs, of a sunscreen and/or thermal insulated unit are not presently available. The present invention seeks to provide such an assembly which may be easily constructed, installed and completed on site, regardless of the sizing of the existing windows.

OBJECTS AND ADVANTAGES

It is therefore the principal object of the present invention to provide a sunscreen and/or thermal barrier assembly, which is formed of three basic components which are constructed in a manner such that each of the components may be cut to any desired size, based upon the sizing and dimensions of an existing window, thereby to create a rectangular window and sunscreen frame, and the components then snapped together to lockingly engage a sunscreen as well as thermal pane therebetween, and the entire rectangular frame then mounted in overlying relationship with respect to an existing window.

In connection with the foregoing object, it is a further object to provide an assembly of the type described, which is formed by a screen frame base and a screen frame insert which lockingly engage in face to face relationship and providing a glass frame member which may similarly be cut to any desired length correspondingly equal to the section lengths of the screen frame base and screen frame insert, the glass frame section further having a mating engagement means associated therewith such that the glass frame member may be cut and constructed into a rectangular frame containing a thermal window therein, and disengageably engaged onto the mount means of the screen frame insert, such that the entire assembly which consists of a sunscreen panel as well as a thermal pane, may be installed over an existing window on location.

In connection with the above object and advantages, the present invention seeks to provide an assembly of the type described, wherein the screen frame base and screen frame insert may be interconnected by locking means integrally formed therewith without the need of any extraneous locking elements or fastening devices, and with a glass frame section which may similarly be formed integrally with locking means which will lockingly engage the glass frame assembly to the screen frame insert without the need for any extraneous locking or fastening members, such that the entire assembly may be cut and constructed to the exact dimensions of any given window on site, and installed without the need of any extraneous locking or fastening members.

Further features of the invention pertain to the particular arrangement of the elements and parts whereby the above-outlined and additional operating features thereof are attained.

The invention, both as to its organization and method of operation, together with further objects and advantages thereof, will best be understood by reference to the following specification, taken in connection with the accompanying drawings.

BRIEF DESCRIPTION OF DRAWINGS

FIG. 4 is a top plan view, partly in cross section, showing the manner in which the completed sunscreen assembly may be mounted to an existing window, and showing a pair of sunscreen panels in sliding relationship one with respect to the other;

FIG. 5 is a side elevational view, in cross section, showing the manner in which the sunscreen and glass frame assemblies may be mounted for rolling engagement in an overlying track;

FIG. 6 is a top plan view, partly broken away, showing a sunscreen assembly which may be hingedly secured to an existing window wherein a pair of sunscreen panels are employed each of the pair being hinged at the outer edges thereof;

FIG. 7 is a top plan view, partly broken away, showing the manner in which a sunscreen assembly of the present invention may be constructed with an enlarged window frame such that two screen panels each of standard width dimensions, may be joined together by means of joining members illustrating that a window may be covered with an assembly of the present invention regardless of size;

FIG. 8 is a side elevational view, broken away, showing the manner in which the joining members are employed to join together adjacent sunscreen panels in those installations where the window is larger than the standard dimensions of a sunscreen panel such that multiple panels must be employed; and FIG. 9 is a top view, in cross section, illustrating the manner in which joining members consisting of a mullion base and a mullion insert may be lockingly engaged to join together a pair of adjacent sunscreen panels in order to permit installation in an oversized window.

BRIEF SUMMARY OF THE INVENTION

In summary, the present invention provides basic components for permitting an operator to construct on site, a sunscreen and thermal barrier assembly, by employing certain standard members which may be cut to size, interconnected, and locked together thereby to form a completed assembly suitable for installation over an existing window. As will be more clearly described hereinafter, the basic assembly is formed by a means of a first component consisting of a screen base having locking means integrally formed therein, and further including gripping means at the lower end thereof, and a screen frame insert which has mating locking means integrally formed therein, and a gripping means associated with the lower end thereof. When the screen frame base and screen frame insert are in face to face relationship and pressed together, with a sunscreen panel interposed between the first and second gripping means, the screen frame base and screen frame insert will lockingly engage together, and hold the sunscreen panel firmly between the gripping means. Each of the screen frame base and screen frame insert may be formed of any extruded material, such as aluminum, and may be cut into any desired length, on site, such that a rectangular window frame of any desired dimensions may be constructed and snapped together with a sunscreen panel interposed therebetween. Once the assembly is completed, it is then suitable for permanent mounting over an existing window.

The invention further contemplates the provision of a glass frame section, which again is formed as an elongate extruded member, and which again may be cut to any desired length dimension such that a rectangular frame may be constructed. The glass frame section includes mounting means which will matingly engage with mounting means formed integrally with the screen frame insert, and wherein the glass frame section further includes a channel for holding a glass panel in position therein. It will therefore be appreciated that the glass frame section may be cut into correspondingly equal lengths as the screen frame base and screen frame insert, to yield a completed assembly.

DETAILED DESCRIPTION OF DRAWINGS

Figure 1:
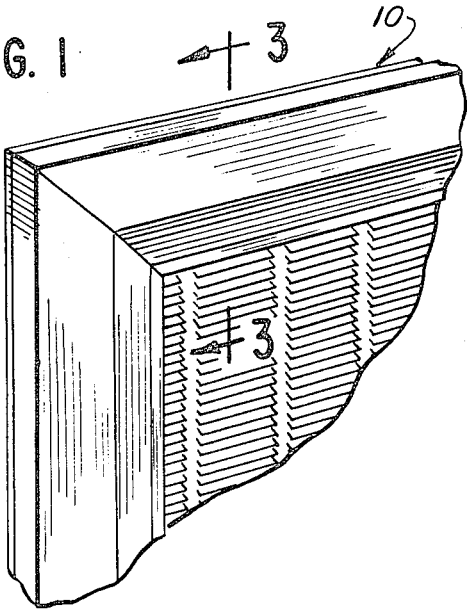
FIG. 1 is a side elevational plan view, partly broken away, showing a corner of the completed sunscreen assembly as cut and joined together and ready for installation over an existing window.
Figure 2:
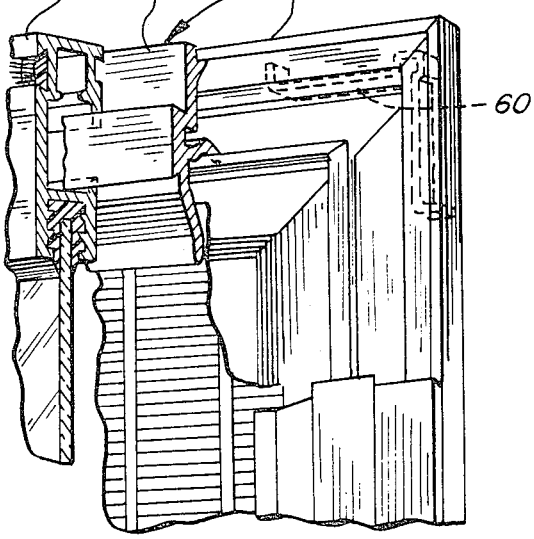
FIG. 2 is a side elevational view, partly in cross section and partly broken away, showing the arrangement of the various components of the sunscreen and thermal insulated barrier assembly as assembled and ready for installation.

As shown in FIGS. 1 and 2 of the drawings, the sunscreen and window assembly 10 of the present invention is illustrated. The assembly 10 is basically formed from three basic components, consisting of a screen frame base 12, a screen frame insert 14, and a glass frame member 16. Each of the three principal components, the screen frame base 12, the screen frame insert 14 and the glass frame member 16 are produced in the form of an extruded element, formed of a material such as aluminum or the like, and adapted for being cut into length portions as may be desired by the operator. The manner in which the three components may be cut and shaped into a framing assembly to overlie an existing window will be described in greater detail hereinafter.

Figure 3A:
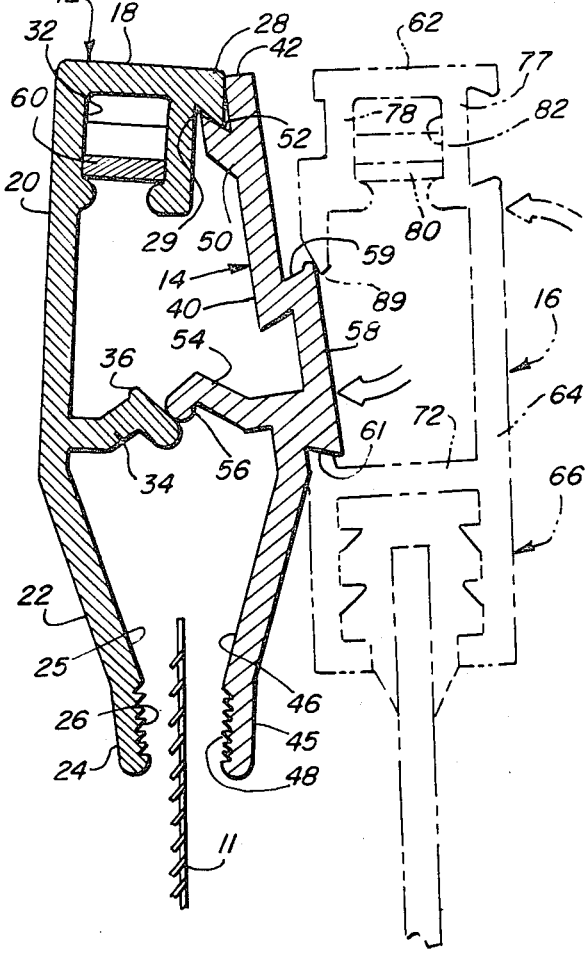
FIG. 3*a* is a side elevational view in cross section, showing the components of the sunscreen assembly as partially assembled, and further showing the glass frame section in phantom, illustrating the manner in which the components interlock.
Figure 3B:
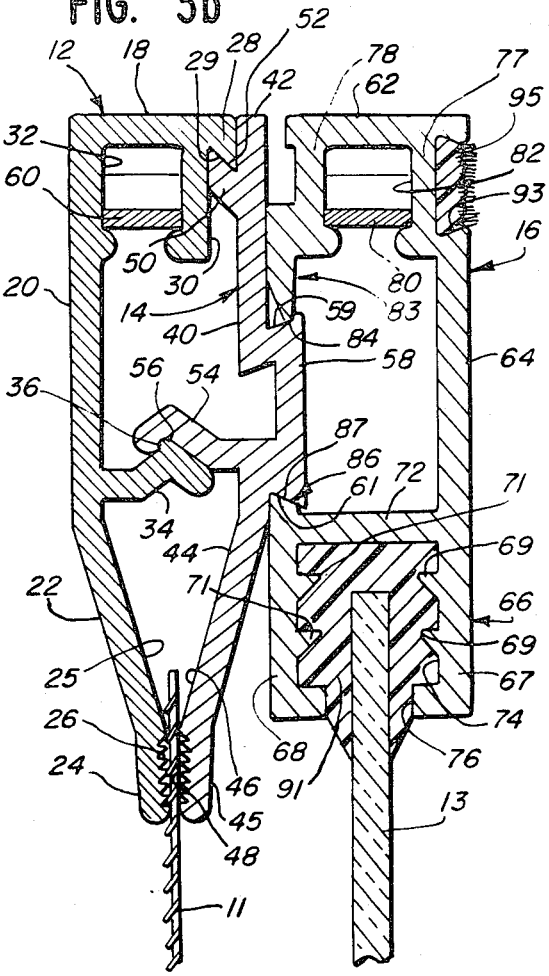
FIG. 3*b* is a side elevational view, in cross section, showing the three principal components of the sunscreen and glass frame assembly fully constructed, and illustrating the manner in which the various components interlock.

With respect to FIGS. 3*a* and 3*b* of the drawings, the detailed construction of each of the three principal components is illustrated. The screen frame base 12 is basically formed in a manner to include a top rail 18, a side rail 20, and a lower angularly inclined holding arm 22. The angularly inclined holding arm 22 terminates in a lower nose end 24 which further includes an interior surface 25 having gripping means associated therewith in the form of a plurality of serrations 26 formed therein.

The top rail 18 of the screen frame base 12 terminates in an outer lock rail 28 formed with v-shaped undercut portion 29. The top rail 18 further includes a depending rib member 30 spaced apart from a portion of the side rail 20, thereby to form an interior lock receiving chamber 32 therebetween. The side rail 20 is further provided with a lock receiving foot 34 formed integrally therewith, and extending outwardly therefrom in the direction of the depending rib member 30. The lock receiving foot 34 is positioned at an approximate mid-position point between the top rail 18 and the lower nose end 24.

It will be appreciated from a view of either FIGS. 1 or 2 of the drawings, that the screen frame base 12 is formed from an extruded piece of material, in an elongate construction, and is capable of being cut at any desired length, which will depend upon the configuration of the window which the operator is attempting to overlay with the screen frame assembly 10 of the present invention.

The second principal component of the present invention forming a sunscreen and window assembly 10 is shown to include a screen frame insert 14 which is designed to lockingly mate with the screen frame base 12. As shown in FIGS. *3a* and *3b* of the drawings, the screen frame insert 14 is formed from a side support rail 40, which extends from a top end 42, and terminates in an angularly inclined second holding arm 44. The angularly inclined second holding arm 44 terminates in a lower nose end 45 having an interior surface 46 and further provided with gripping means formed by a plurality of serrations 48.

Positioned adjacent the top end 42 of the side rail 40 and formed integrally therewith is a locking rib 50 which is provided with a v-shaped channel 52 as particularly shown in FIGS. *3a* and *3b*. The locking rib 50 with the v-shaped channel 52 formed therin is positioned such that the rib 50 will matingly engage the outer lock rail 28 by having the v-shaped channel 52 matingly engage with the v-shaped undercut 29 formed in the screen frame base 12.

Spaced at the approximate mid-position between the top end 42 and the lower nose end 45 is a lock foot 54 which is formed integrally with the side support rail 40, and extends inwardly therefrom such that when the screen frame base 12 and screen frame insert 14 are brought into face to face relationship, the lock foot 54 will ride over and lockingly engage with the lock receiving foot 34 in the manner shown in FIG. *3b*. To further enhance the locking relationship between the lock receiving foot 34 and the lock foot 54, it will be observed that the lock receiving foot 34 includes a projecting nib 36, while the lock foot 54 is provided with a corresponding nib channel 56 such that when the lock foot 54 rides into locking engagement with the lock receiving foot 34, the projecting nib 36 will ride into the nib channel 56 and thereby achieve a locking relationship, while simultaneously, the locking rib 50 having the v-shaped channel 52 will ride into the v-shaped undercut 29 of the outer lock rail 28. Hence, a positive lock as between the screen frame base 12 and the screen frame insert 14 will be achieved.

The side support rail 40 is further shown to be provided with a mount rail 58 having an upper inclined lock channel 59, and a lower reverse inclined lock channel 61.

Once again, the screen frame insert 14 is provided as an extruded member which may be formed of any appropriate material, and comes in an elongate configuration such that the screen frame insert 14 may be cut into any desired length. It will be appreciated from a view of either FIGS. 1 or 2 of the drawings, that the operator need only measure the window opening which is intended to be covered by the sunscreen and window frame assembly 10 of the present invention, and then cut the screen frame base 12 and screen frame insert 14 into correspondingly equal sections such that an entire rectangular frame may be constructed. As shown in FIGS. 1 and 2, if each of the members is cut on an exact 45° angle, the screen frame base 12 and screen frame insert 14 may be lockingly engaged to form a rectangular frame, the respective tops and sides of the frame assembly 10 being held in position by means of lock clips 60 which are inserted in correspondingly mating lock receiving chambers 32 formed in the screen frame base 12. The lock clips 60 may be formed of a material which is naturally spring biasing such that corresponding sections of the screen frame base 12 which are cut on 45° angles and matingly engaged are securely held in position by the clips 60.

The third principal component of the sunscreen and window frame assembly of the present invention is provided by means of a glass frame member 16. Glass frame member 16 is formed by a top end 62, a side rail member 64, and terminating in a lower glass support section 66. The lower glass support section 66 is, in turn, formed by a pair of opposed glass support rails 67 and 68 respectively, which are positioned in opposed relationship one to the other, and each including a plurality of glass holding serrations 69 and 71 respectively. It will be appreciated from a view of FIG. *3b* of the drawings, that the opposed glass support rails 67 and 68 are formed integrally with a top chamber wall 72 such that a glass holding chamber 74 is formed therebetween. The glass holding chamber 74 is shown to have an open section 76 at the lower end thereof in order to permit a glass panel 13 to extend therethrough.

The glass frame member 16 is further shown to be provided with a pair of opposed upper arms 77 and 78 respectively, depending downwarding for a short distance from the top end 62 of the glass frame member 16. Hence, there is formed between the opposed upper arms 77 and 78 and the top end 62 of the glass frame member 16 a second lock receiving chamber 82 which is adapted to carry a second lock clip 80.

Extending downwardly from the opposed upper arm 78 is a lock arm 83, having a champhered lower edge 84, and a lower lock ledge 86, spaced from and in vertical alignment with the lock arm 83. The lower lock ledge 86 is shown to have an angularly inclined surface 87 as shown in FIG. *3b*. It will be appreciated from a view of FIGS. *3a* and *3b* of the drawings, that the spacing between the lock arm 83 and the lock ledge 86 creates a mount rail receiving chamber generally denoted by the numeral 89 therebetween. As illustrated, the glass frame member 16 may therefore be mounted to the screen frame insert 14 by lockingly engaging the mount rail 58 formed in the screen frame insert 14 into the mount rail receiving chamber 89 formed in the glass frame member 16 such that the two components are disengageably engaged together.

It will further be observed that a sunscreen panel 11 is designed to be carried between the opposed serrations 26 and 48 respectively formed on the interior surfaces 25 and 46 of the screen frame base 12 and the screen frame insert 14 such that when those two components are lockingly engaged, the sunscreen panel 11 will be securely held between the lower nose ends 24 and 45 of the respective members 12 and 14.

As further shown in FIGS. *3a* and *3b*, a glass panel 13 can be securely held in position in the glass holding chamber 74 by providing a resilient glazing material 91, formed from a material such as vinyl or the like. The resilient glazing material 91 is appropriately notched such that a pane of glass 13 may be held securely therein, and when assembled, will be positioned exteriorly of the sunscreen panel 11.

It will now be appreciated from a view of FIGS. 1 through 3b that the combination sunscreen and window frame assembly 10 may be conveniently constructed on a given construction site without the need of any separately measuring and ordering specially constructed frame assemblies with the concomitant waiting for delivery. As depicted in FIGS. 1 and 2 of the drawings, an existing window frame can be measured, and then correspondingly equal sections of screen frame base 12 and screen frame insert 14 may be cut with the edges being cut on a 45° angle. Sections for a top member, bottom member and opposed side members are cut such that a rectangular frame is thereby created. The frame formed by the screen frame base 12 is securely locked by applying locking clips 60 in the lock receiving chamber 32 of mating adjacent sections of the screen frame base 12, such that the locking clips 60 will securely and lockingly hold each of the four sections forming the rectangular frame in position. Once proper lengths of the screen frame base 12 have ben cut, and correspondingly equal sections of the screen frame insert 14 are similarly cut, the rectangular dimensions of the resulting frame may then be measured, and a sunscreen panel 11 cut into a size corresponding to the length and width dimensions of the frame so formed. The sunscreen frame assembly 10 may then be snapped together with the sunscreen panel 11 positioned such that upon locking engagement of the screen frame base 12 and screen frame insert 14, the panel 11 will be securely held between the corresponding serrations 26 and 48 respectively of the two members. Once the entire rectangular frame with the sunscreen panel 11 mounted therein has been formed, the assembly may then be mounted over the existing window.

It will further be appreciated that the provision of the glass frame member 16 may take the form of an additional component if desired. In other words, the operator need not mount a thermal pane glass frame member 16 with a glass panel 13 carried therein superimposed over the sunscreen assembly 10 having a sunscreen 11 positioned therein. However, in those installations where desired, such as colder climates, it may be desirable to provide the additional thermal barrier formed by the glass panel 13, and in such event, the operator need only to take extruded sections of the glass frame member 16, and cut sections correspondingly equal to the screen frame base 12 and the screen frame insert 14 members heretofore cut to form the original rectangular arrangement. In this event, a glass pane would be cut to an accordingly proper size such that it would be accommodated within the rectangular frame created by the glass frame member 16 once cut into four sections equivalent to the top and bottom members and the opposed side members, and then pressingly engaged within the resilient glazing material 91 contained within the glass holding chambers 74. It is contemplated that the operator would desire to have the glass frame member 16 be disengageably engageable with respect to the mount rail 58 carried on the screen frame insert 14, and hence the locking mating surfaces as between the lock arm 83 and the lock ledge 86, as well as the upper inclined lock channel 59 and lower reverse lock channel 61 formed on the lock rail 58 are designed such that respective surfaces may be disengageably oriented as illustrated. Hence, should the operator wish to clean the glass panel 13 on both surfaces thereof, the entire glass frame member 16 may be disengaged from the mount rail 58 in order to permit the cleaning thereof, and then reinstalled. Hence, the tolerance as between the respective locking surfaces would be such that an appropriate tool such a screw driver or the like would be utilized to unsnap the glass frame member 16 from the sunscreen assembly 10 to permit cleaning, after which the same may be snapped back on in lock fitting engagement.

It will further be noted from a view of FIG. 3b of the drawings, that the glass frame member 16 may further be provided with a weather strip channel 93 which is designed to carry weather stripping 95 therein. Hence, if the outer portion of the glass frame member 16 were to have an overlay of any type position thereover, a thermal barrier could be established.

With respect to FIG. 9 of the drawings, an additional optional feature of the invention is provided. It is known, for example, that sunscreen panel material 11 is usually manufactured and provided in certain standard length and width dimensions. Typically, the material will be distributed in a commercially available size which will usually come in a 4 foot width dimension. Hence, in those installations where a given window may have a width dimension in excess of 4 feet, it might become necessary that multiple sunscreen panels 11 would have to be employed in order to create an entire sunscreen frame assembly 10 sufficient to cover the existing window. In such an event, the present invention contemplates the provision of a mullion base 100 (see FIG. 9), which takes the form of a u-shaped member having a top section 102, opposed side members 103 and 104 respectively, and interior feet 106 and 107 respectively. Positioned centrally of the top section 102 and extending interiorally therefrom is a lock rail 108 which extends along the length of the mullion base 100. There is further provided a correspondingly mating mullion insert 110 formed by a mullion rail 112 having a centrally positioned lock knob 114 extending along the entire length of the mullion insert 110. As shown in FIG. 9, a pair of adjacent screen frame panels 11 may be joined together along the side edges thereof, by positioning one of each of the edges of adjacent screen panels 11 on either side of the lock knob 114 of the mullion insert 110 and then lockingly engaging the mullion base 100 into locking position by locking the lock knob 114 into locking engagement with the lock rail 108. In this manner, multiple sunscreen panels 11 may be interconnected by means of an elongate vertically positioned mullion base 100 and mullion insert 110 such that any size window opening may be covered by a sunscreen assembly 10 according to the present invention. It will also be appreciated that the mullion base 100 and mullion insert 110 combination further provides vertical structural rigidity for the assembly, since the mullion base 100 with its accompanying insert 110 extends the entire vertical dimension of the sunscreen assembly 10 and hence further rigidifies the assembly.

If desired, as shown in FIG. 5 of the drawings, the invention may be provided with a top hanging rail 120 having a pair of slide channels 122 and 124 formed therein in a manner which is known in the art. The slide channels 122 and 124 are spaced apart a distance thereby to accommodate a pair of hanging wheels 126 and 128 respectively which are carried at the top portion of a bracket 130, the bracket 130 being securely mounted to the upper surfaces of a pair of equally formed sunscreen assembly 10 respectively.

Hence, as shown in FIG. 4 of the drawings, if desired, an operator may install the sunscreen assembly 10 of the present invention by providing a pair of equally constructed panels in overlying and sliding engagement by installing a top rail 12 in overlying relationship to the top frame of the window to be covered, generally depicted by the numeral 150. In accordance with this construction, once installed on the existing window 150, each of the panels may be slidingly moved in order to permit windows to be opened and the like.

As shown in FIG. 6 of the drawings, an alternate construction over an existing window 150 shows a pair of panels 1 which overlie an existing window 150 and hingedly secured thereto by means of a pair of opposed hinges 135. In this installation, each of the sunscreen assemblies 10 may be opened by pivoting the same away from the window since each of the side sunscreen panels 10 will pivot around a corresponding hinge 135.

As shown in FIG. 7 of the drawings, an oversized window 150 is depicted in an existing structure. An enlarged sunscreen assembly of the present invention may be constructed, as previously indicated, by employing a mullion base 100 in combination with a mullion insert 110 to lockingly engage a pair of sunscreen panels 11 therebetween such that the entire window structure 150, even though enlarged, may be fully covered.

In accordance with FIG. 8, an assembly of the present invention shown to be installed over an existing window structure 150 is illustrated wherein the entire assembly is reversed such that the glass frame member 16 is positioned interiorly of the sunscreen assembly 10, and wherein further, the window structure 150 is an enlarged structure such that a pair of sunscreen panels 11 must be employed in side by side adjacent relationship and held in position by the combination of a mullion base 100 and mullion insert 110. In this type of installation, the advantage of providing the glass frame member 16 with a weather strip channel 93 containing weather stripping 95 is shown to be a desirable construction since the weather stripping material 95 would be in touching contact with the outer frame of the existing window 150 thereby to provide a solid thermal barrier therebetween. However, the difficulty with an installation of this type is that the glass frame member 16, once mounted on to the mount rail 58 of the screen frame insert 14 cannot be conveniently removed for cleaning purposes.

It is conteplated that the components forming the sunscreen and window frame assembly of the present invention may be formed of an extruded material, which can include either a plastic material, or more ideally, an aluminum material. It is considered more feasible and economically efficient to use a metal such as aluminum, for the reason that aluminum has the ability to withstand extremes of temperature, such that the window frame assembly of the present invention may be used in virtually all climates. In those climatic areas where temperature extremes are realized, such as in portions of the country where heat temperatures may exceed 100°, or in those areas where low temperatures may go below 0°, a plastic material might be capable of a material breakdown, whereas aluminum can easily withstand such temperature variations. In either event, it is contemplated that each of the screen frame base 12, screen frame insert 14, glass frame member 16, as well as the mullion base 100 and mullion insert 110 be provided in standardized elongate lengths such that the worker may cut desired lengths of each of the components in order to readily construct a rectangular frame assembly on the construction site as part of the installation process. It will also be appreciated that by providing the components in their present format, each of the various components may be readily snapped together to form a complete system, thereby eliminating the need to premeasure windows and have the sunscreen and/or thermal window frame assemblies manufactured at a separate location and shipped to the construction site. Hence, it is contemplated that the present invention provides the first instance of both a sunscreen as well as a thermal barrier assembly which may be readily constructed on site by providing components which may be cut to precise measurements, and the entire assembly snap fitted together in a reasonably short period of time, mounted to an existing window, and completing the assembly thereby to form not only a sunscreen but also a thermal barrier installation.

While there has been described what is at present considered to be the preferred embodiments of the invention, it will be understood that various modifications may be made therein and it is intended to cover in the appended claims all such modifications as fall within the true spirit and scope of the invention.

I claim:

1. A snap together sunscreen assembly for installation in overlying relation to an existing window comprising in combination, a screen frame base having an upper end terminating in a top rail and a lower end terminating in a lower nose end having an interior surface and including first gripping means associated therewith, said screen frame base having first locking means formed thereon, said first locking means comprising an undercut recess formed along said top rail of said screen frame base, a screen frame insert having an upper end terminating in a top edge and a lower end terminating in a lowered nose end having an interior surface and including second gripping means associated therewith and an exterior surface thereof, said screen frame insert having mating locking means formed thereon for mating engagement with said first locking means of said screen frame base, said mating locking means comprising a mating locking rib formed along said upper end of said screen frame insert, said locking rib of said screen frame insert being engageable within the confines of said undercut recess formed along said top rail of said screen frame base, a lock receiving foot carried on said screen frame base approximately intermediate said upper end and said lower nose end thereof, a locking foot carried on said screen frame insert approximately intermediate said upper end and lower nose end thereof, said locking foot adapted for locking engagement with said lock receiving foot when said screen frame base and screen frame insert are pressed together in face to face relationship, each of said screen frame base and screen frame insert being adapted to be cut into correspondingly equal sections thereby to form a rectangular frame assembly sized to fit any desired window in overlying relation, and a sunscreen panel sized for containment with said rectangular frame and held in place by said first and second gripping means when said screen frame base and screen frame insert sections are lockingly engaged thereby to form said rectangular frame.

2. The sunscreen assembly as set forth in claim 1 above, wherein said screen frame insert further includes mounting means formed thereon, a glass frame section adapted to carry a glass panel therein, said glass frame section provided with mating mounting means adapted for mating engagement with said mounting means formed on said screen frame insert, whereby said glass frame section may be cut into sections correspondingly equal to said screen frame base and screen frame insert sections thereby to form a rectangular glass frame assembly of substantially equal rectangular dimensions with respect to said sunscreen frame assembly with the glass panel contained therein, and said glass frame assembly being disengageably engageable on said screen frame insert thereby to form a combination sunscreen and thermal insulated assembly capable of installation in overlying relation to an existing window.

3. The sunscreen assembly as set forth in either of claim 1 above, wherein said gripping means comprises a plurality of serrations carried along a portion of said interior surface of said lower nose end of said screen frame base, and a plurality of serrations carried along a portion of said interior surface of said lower nose end of said screen frame insert, whereby said serrations grippingly engage said sunscreen panel therebetween when said screen frame base and screen frame insert are lockingly engaged together.

4. The sunscreen assembly as set forth in either of claims 2 or 1, wherein said mounting means on said screen frame insert comprises a mounting rail formed along said exterior surface of said screen frame insert, and said mating mounting means of said glass frame section comprises a rail chamber formed along the length of said glass frame section, whereby said rail chamber is adapted to disengageably engage said mounting rail thereby to mount said glass frame assembly to said screen frame assembly.

5. The sunscreen assembly as set forth in claim 1 above, which further includes a mullion base adapted for vertical positioning between opposed sides of said rectangular frame and between adjacent sunscreen panels carried within a single rectangular frame, said mullion base provided with locking means formed therein, and a mullion insert adapted for positioning in overlying relation to said mullion base and provided with mating locking means for matingly engaging said locking means of said mullion base, whereby multiple adjacent sunscreen panels may be lockingly engaged within a single rectangular frame when interposed between said mullion base and mullion insert.

6. A snap together sunscreen assembly adapted for installation in overlying relationship to an existing window comprising in combination, a unitary screen frame base formed by a top rail having an exterior edge and an interior edge, a side rail depending from said exterior edge, an angularly inclined holding arm portion depending from said side rail, said holding arm terminating in lower nose end, said nose end having first gripping means positioned along one surface thereof, a rib member depending from said interior edge of said top rail for a short distance, said rib member being spaced from said side rail thereby to form an interior chamber bounded by said top rail, side rail and depending rib member and being open along the bottom portion thereof, an outer lock rail extending along said interior edge of said top rail and having an undercut section extending along the length thereof, and a lock receiving foot extending laterally outwardly from said side rail in the direction of said interior edge of said top rail and positioned approximately intermediate said top rail and said lower nose end thereof, a unitary screen frame insert adapted for engagement with said screen frame base, said screen frame insert formed by a side support rail having a top edge and terminating in a lower nose end having second gripping means positioned along one surface thereof, said side support rail having an interior surface and an exterior surface, a locking rib extending angularly outwardly from said interior surface of said side support rail adjacent said top edge and adapted for mating engagement for said undercut section of said screen frame base, a locking foot extending laterally outwardly from said interior surface of said side support rail intermediate said top edge and said lower nose end thereof and adapted for mating engagement with said lock receiving foot of said screen frame base, each of said screen frame base and screen frame insert being elongate in configuration and adapted to be cut into equal top and bottom and equal side frame members and adapted for locking engagement therebetween thereby to form a rectangular frame, and a sunscreen panel interposed between said respective first and second gripping means of said respective lower nose ends of said screen frame base and screen frame insert and within said rectangular frame when fully assembled, whereby the rectangular frame may be constructed to fit any existing window on overlying relation by cutting each of said screen frame base and screen frame insert into equal top and bottom rails and equal side frame members, and lockingly engaging said members together with said sunscreen panel interposed therebetween.

7. The sunscreen assembly as set forth in claim 6 above, wherein said screen frame insert further includes mounting means formed thereon, a glass frame section adapted to carry a glass panel therein, said glass frame section provided with mounting means adapted for mating engagement with said mounting means formed on said screen frame insert, whereby said glass frame section may be cut into section correspondingly equal to said screen frame base and screen frame insert section thereby to form a rectangular glass frame assembly of substantially equal rectangular dimensions with respect to said sunscreen frame assembly with a glass panel contained therein, and said glass frame assembly being disengageably engageable on said screen frame insert and matingly engaging said mating mounting means on said glass frame section with said mounting means formed on said screen frame insert such that when assembled, said assembly includes a combination sunscreen and thermal insulated assembly capable of installation in overlying relation to an existing window.

8. The sunscreen assembly as set forth in either of claim 6 or 7, which further includes a mullion base adapted for vertical positioning between opposed sides of said rectangular sunscreen frame assembly and between adjacent sunscreen panels carried within a single rectangular frame, said mullion base provided with locking means formed integrally therein, and a mullion insert adapted for positioning in overlying relation to said mullion base and provided with mating locking means for mating engaging said locking means of said mullion base, whereby adjacent sunscreen panels amy be lockingly engaged within a single rectangular frame when interposed between said mullion base and said mullion insert, and said mullion base and mullion insert being lockingly engaged.

* * * * *